US005678288A

United States Patent [19]

Walton et al.

[11] Patent Number: 5,678,288

[45] Date of Patent: Oct. 21, 1997

[54] COMPRESSIVELY TREATING FLEXIBLE SHEET MATERIALS

[75] Inventors: Richard R. Walton, Ten West Hill Pl., Boston, Mass. 02114; George E. Munchbach, Roslindale; Richard C. Walton, Sherborne, both of Mass.

[73] Assignee: Richard R. Walton, Boston, Mass.

[21] Appl. No.: 20,551

[22] Filed: Feb. 22, 1993

[51] Int. Cl.[6] ..... D06C 21/00; D06C 23/04

[52] U.S. Cl. ..... 26/18.6; 162/111; 162/280; 264/282

[58] Field of Search ..... 26/18.6, 18.5, 26/21, 99; 28/155, 156, 157; 162/111, 280, 281, 282, 361; 264/282, 283

[56] References Cited

U.S. PATENT DOCUMENTS

| | | | |
|---|---|---|---|
| 2,890,515 | 6/1959 | Parker et al. . | |
| 3,260,778 | 7/1966 | Walton et al. . | |
| 3,390,218 | 6/1968 | Painter et al. . | |
| 3,426,405 | 2/1969 | Walton | 26/18.6 |
| 3,427,376 | 2/1969 | Dempsey | 264/282 |
| 3,452,409 | 7/1969 | Trifunovic et al. . | |
| 3,581,614 | 6/1971 | Catallo | 26/82 |
| 3,597,814 | 8/1971 | Trifunovic et al. . | |
| 3,810,280 | 5/1974 | Walton et al. . | |
| 3,975,806 | 8/1976 | Walton et al. | 26/18.6 |
| 4,118,841 | 10/1978 | Diggle, Jr. . | |
| 4,142,278 | 3/1979 | Walton et al. . | |
| 4,432,927 | 2/1984 | van Tilburg et al. | 26/18.6 |
| 4,717,329 | 1/1988 | Packard et al. . | |
| 5,060,349 | 10/1991 | Walton et al. . | |
| 5,117,540 | 6/1992 | Walton et al. . | |

FOREIGN PATENT DOCUMENTS

| | | |
|---|---|---|
| 2 361 222 | 10/1978 | France . |
| 1 018 716 | 10/1957 | Germany . |
| 1104972 | 3/1968 | United Kingdom . |
| 2 116 593 | 9/1983 | United Kingdom . |

*Primary Examiner*—Amy B. Vanatta
*Attorney, Agent, or Firm*—Fish & Richardson P.C.

[57] ABSTRACT

Apparatus for longitudinal compressive treatment of a continuous web of material. The apparatus comprises a cylindrical drive roll for advancing the web, a smooth-surfaced primary member to press the web against the drive roll, and a generally-stationary retarder downstream of the primary member to engage and retard the web before the web has left the drive roll. The retarder surface has a large multiplicity of parallel ridges and grooves set on a diagonal, and effective to cause longitudinal compression of the web and to cause the web to flow at an angle to the original direction of drive. The retarder surface also has a reorienting retarding surface, effective after the web advances incrementally at the angle, to effect further compression and to reorient the travel of the web to be generally parallel to the original direction of drive.

23 Claims, 6 Drawing Sheets

COMPRESSIVELY TREATING FLEXIBLE SHEET MATERIALS

BACKGROUND OF THE INVENTION

The invention relates to the longitudinal compressive treatment of webs in which a stationary retarder surface acts upon a driven web to cause the web to slow and longitudinally compact or crepe in a treatment zone. This technique, sometimes referred to as microcreping because of its ability to produce fine crepes, is exemplified by our prior U.S. Pat. Nos. 3,810,280, 4,142,278 and 5,060,349, which are incorporated herein by reference.

As described in our '349 patent, a particularly-advantageous retarder sheet for a microcreper comprises a large multiplicity of parallel ridges and grooves biased obliquely to the direction of drive of the web. However, in some cases a web treated by such a retarder member, as it passes from the smooth primary surface to the obliquely-grooved retarder surface, may tend to travel at an angle to the feeding direction of the roll, and deform into a parallelogram. The treated web may retain this deformation even after it is wound onto a take-up roll.

Previous methods of correcting this parallelogram deformation have resulted in deformations to the web, for instance stretching that has tended to defeat the purpose of the compressive treatment, or uneven stretching of the web that give the web an undesired, Moiré textured appearance.

SUMMARY OF THE INVENTION

It is an object of the invention to provide an improved microcreper that uses a retarder surface with a large multiplicity of parallel ridges and grooves biased obliquely to the direction of drive of the web, but which produces a treated web without having a detrimental tendency to travel at an angle to the feed direction of the roll and without distorting the web into a parallelogram, and that does not impart a Moiré pattern, or other blemishes, to the web.

In general, in a first aspect, the invention relates to an apparatus for longitudinal compressive treatment of a continuous web of material, the apparatus comprising a cylindrical drive roll for advancing the web, a smooth-surfaced primary member to press the web against the drive roll, and a generally-stationary retarder downstream of the primary member to engage and retard the web before the web has left the drive roll. According to the invention, the initially-effective retarder surface of the retarder, which has a large multiplicity of parallel ridges and grooves extending across the width of the web, is combined with a reorienting retarding surface. The ridges of the initially-effective retarding surface are uniformly biased obliquely to the direction of drive of the web, and are effective to cause longitudinal compression of the web together with orientation of the web to flow at an angle to the original direction of drive of the web induced by the drive roll. The reorienting retarding surface is disposed to be effective after an incremental advance of the web at the angle, the reorienting retarding surface constructed to have a supplementary retarding effect that is cooperative with said drive roll to reorient the travel of the web to a direction generally parallel to the original direction of drive.

In one preferred embodiment, the retarder has two ridge-and-groove regions, the upstream region providing the initially-effective retarder surface, and the more-downstream region forming the reorienting retarding surface. The ridges of the downstream region are biased in a reverse angle relative to that of the ridges and grooves of the upstream ridge-and-groove region. In preferred cases, the bias angle of the downstream region, e.g., forty-five degrees, is larger than the bias angle of the upstream region, e.g., thirty degrees.

In another preferred embodiment, the reorienting retarding surface comprises roughening of the surface within the grooves of the retarder, the ridges having smooth flat tops over which the web can slide. The roughening is applied to the surface within the grooves of the retarder by plasma coating. The drive roll has a rougher surface than the surface within the grooves of the retarder.

These and other preferred embodiments may include the following features. The retarder comprises a sheet-form member that can be reoriented in the machine to expose a different portion of the sheet to wear. The ridges have flat top surfaces for engaging the web, which, in certain preferred embodiments, are plated with a hard, smooth material. The ridges have sharp edges. The primary member and retarder comprise an assembly of superposed sheet members extending across the width of the web on the drive roll.

Microcrepers according to the invention offer a number of advantages. During the process of manufacturing knit goods, the knit web is stretched, cut, and pulled through a number of processing steps. Because the web is in longitudinal tension during much of this manufacture process, the web tends to neck down, that is, to reduce in width and stretch in length. These manufacturing steps tend to impart uneven deformations to the web, degrading the appearance of the web and impairing easy manufacture of dimensionally-stable finished goods. A microcreper according to the invention, when used as the last stage in a knit manufacture line before the knit is cut and sewn, tends to widen the web, correcting the necking-down. The uneven tensions in the web are allowed to even out across the length and width of the web, improving the manufacturing characteristics of the web. The multiple grooves and ridges of the retarder surface produce a treated web with especially desireable properties. The web comes off the microcreper straight, without parallelogram deformation. Because the retarder surface does not have sharp points, as would be found on a roughened retarder surface, the retarder surface does not pick loops from nor cause fuzziness in the web, nor does it ablate dust from the web.

In a second aspect, the invention relates to an apparatus for longitudinal compressive treatment of a continuous web of material, the apparatus comprising a cylindrical drive roll for advancing the web, an assembly of sheet-form members to press the web against the drive roll, said drive roll and primary member being wider than the web, and a tape of a tough, slippery material, the tape held generally stationary in the portion of the engagement region between the sheet assembly and the drive roll not occupied by the web. The tape may preferably be of polyester film.

Other advantages and features of the invention will become apparent from the following description of a preferred embodiment, and from the claims.

FIG. 1 is a perspective view of a so-called bladeless microcreper.

FIG. 1*a* is a top plan view, partially cut away, detailing the treatment region of the microcreper of FIG. 1.

FIG. 1*b* is a diagrammatic cross-section on enlarged scale taken on lines 1*b*/1*b* of FIG. 1*a*.

FIGS. 1*c*–1*e* are section views of the microcreper.

FIG. 2 is a perspective view of a sheet assembly.

FIG. 2*a* is a sectional view of a retarder sheet.

FIG. 3 is a plan view of the underside of a retarder sheet.

FIG. 3*a* is a perspective view of a sheet assembly.

FIG. 3*b* is a side plan view of a sheet assembly.

FIG. 4 is a plan view of the underside of a retarder sheet.

FIG. 4*a* is a sectional view of a retarder sheet.

DESCRIPTION OF THE PREFERRED EMBODIMENTS

Figure 1:
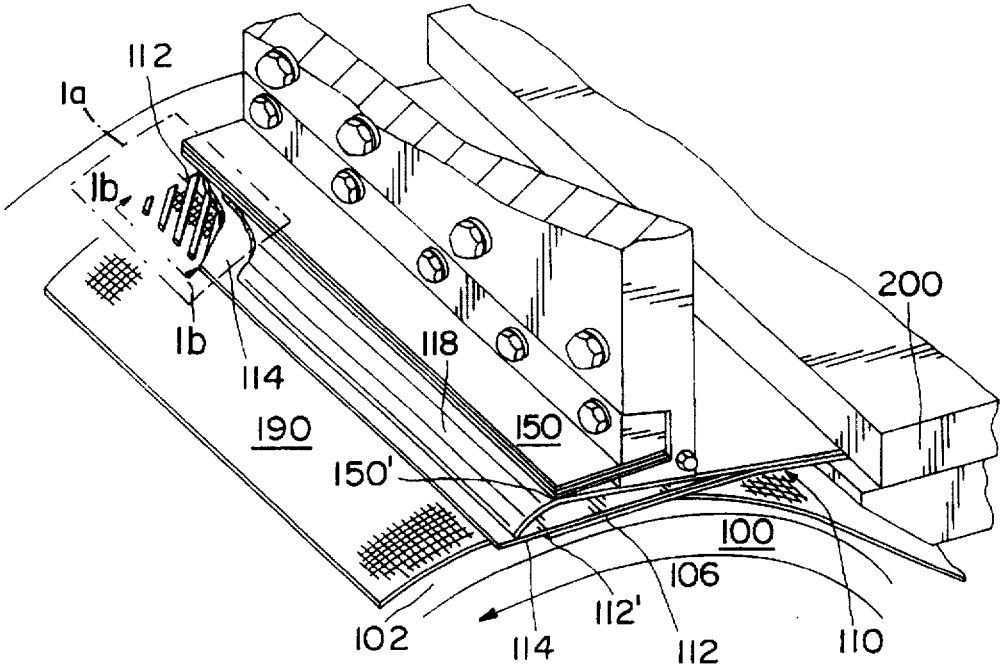

FIG. 1 shows a microcreper according to the invention. A cylindrical drive roll 100 rotates in direction 106 to advance a web of material 190 past feeding shoe surface 112 and retarder surface 114. The roll is typically steel, of e.g. 12-inch diameter, and has a web-gripping surface 102 provided by fine carbide particles applied by plasma coating. The feeding and retarder surfaces are provided as an assembly of sheet-form members mounted in a sheet holder 200 and extending forward. The assembly passes under presser member 150 and over roll surface 102 where it engages web 190 against the ro11.

Figure 1A:
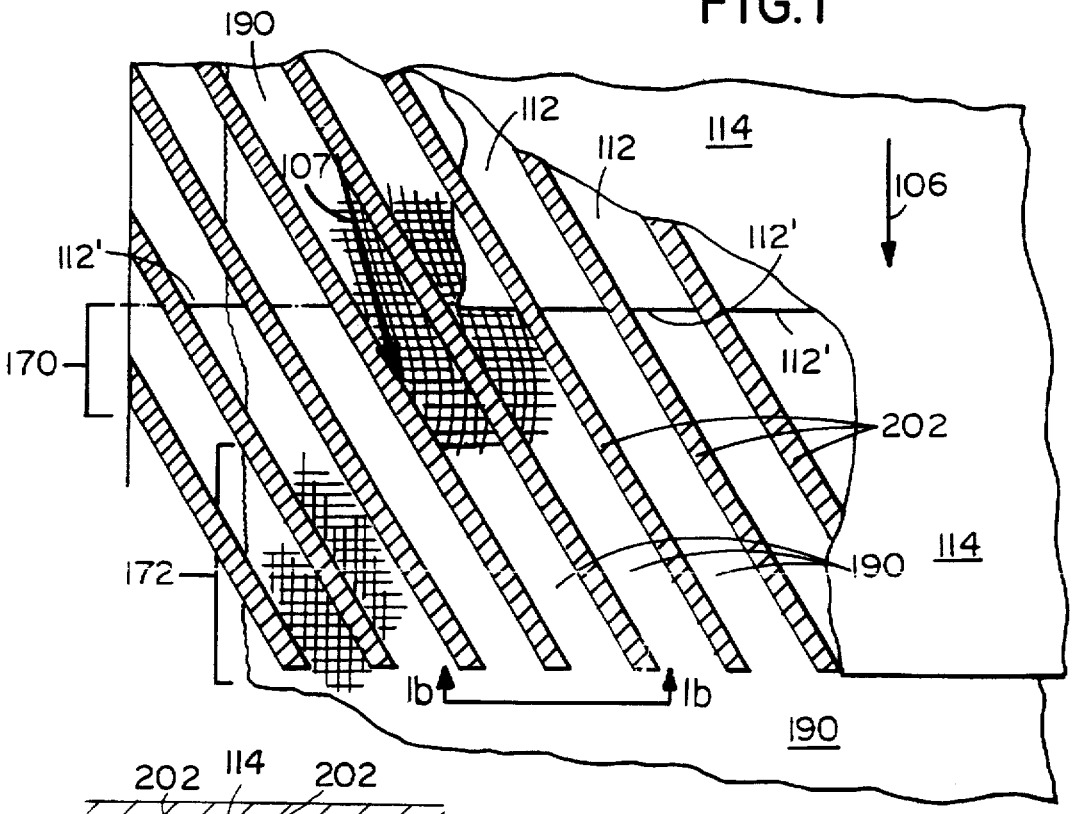
Figure 1B:
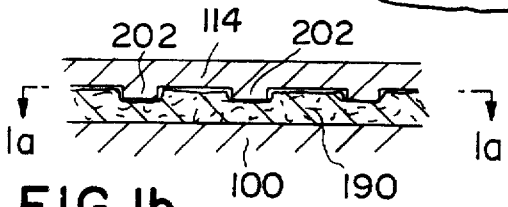

Referring to FIGS. 1*a* and 1*b*, the sheet assembly comprises a primary feeding member 112 closest to the roll, and a retarder sheet 114. The roll-facing surface of the retarder sheet comprises a large multiplicity of parallel ridges and grooves biased obliquely to the direction of drive 106 of the web. The retarder sheet is shown partially cut away, exposing ridges 202. As the web 190 engages the ridges, friction causes longitudinal compression of the web, and the web orients to flow at an angle 107 to the original direction of drive 106 induced by the drive roll, as shown in region 170. For instance, in FIG. 1*a* the ridges are set at 30°, and the web flows at 20°. The retarder surface comprises reorienting retarding surface, not shown, so that after the web has advanced incrementally beyond the region 170 of angled flow, the reorienting retarding surface reorients the travel of the web to a direction generally parallel to the original direction of drive, as shown in region 172. The web, no longer following the grooves, ratchets past the remaining grooves and ridges.

Figure 1C:
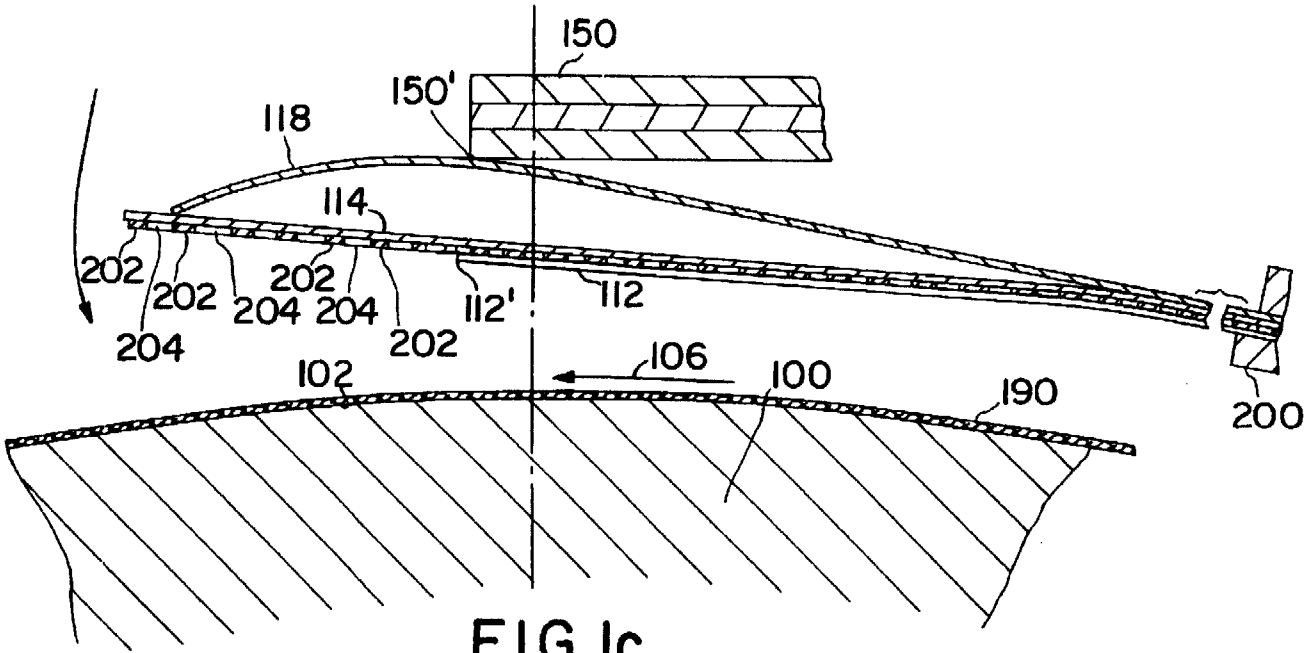

Referring to FIG. 1*c*, from the bottom up, the sheet assembly consists of a primary feeding member 112, one or more retarder sheets 114 which support a retarder surface formed by ridges 202 and grooves 204, and a conformer member 118 of form specially curved to apply force to the tip portion of the sheet assembly. Typically, each of feeding primary 112, retarder 114, and conformer members 118 are formed of sheets of blue spring steel. Feeding primary member 112 has a smooth under-surface and is arranged, by the influence of presser member edge 150', to press web 190 into driven engagement with the surface 102 of drive roll 100. The downstream edge 112' of primary member 112 lies slightly downstream from alignment with presser member edge 150'. Retarder sheet 114 has a large multiplicity of grooves 204 and ridges 202 set obliquely to the direction of drive of the web. The sheet form members are positioned by sheet holder 200, with the free end of the pre-curved conformer member 118 engaged upon the retarder sheet 114 near the free tip of the latter. To reach the operative condition, the head, comprising the presser member 150, the holder 200 and the sheet assembly 110, are rotated as a unit by pneumatic actuators, not shown, to the operative position of FIGS. 1*b* and 1*c*.

Figure 1D:
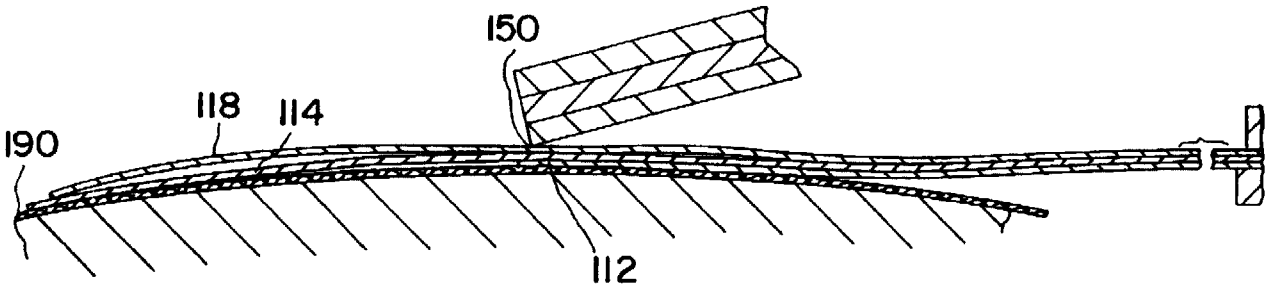
Figure 1E:
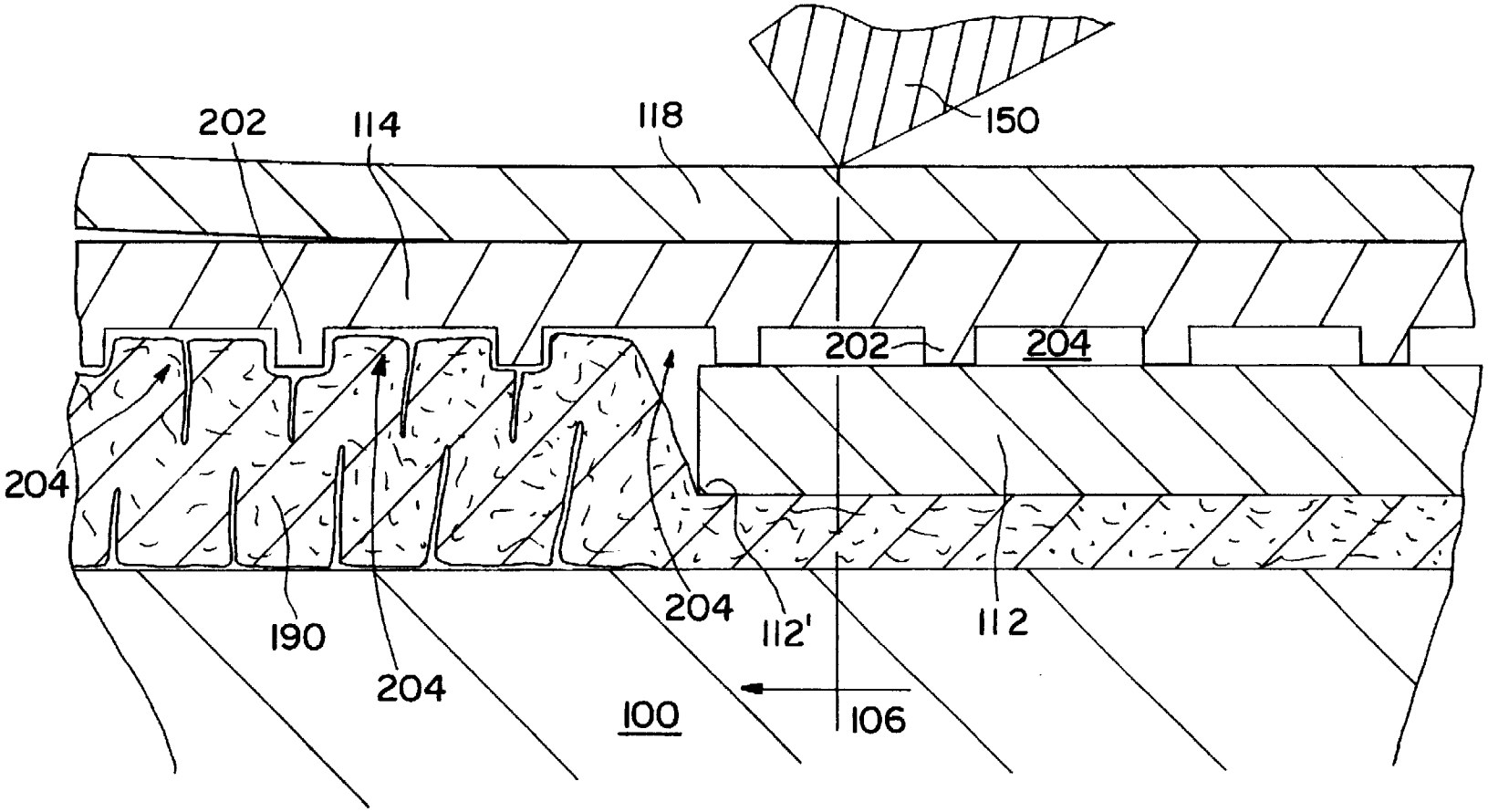

FIG. 1*d* and the magnified view of FIG. 1*e* show a microcreper in operative position. Pressure member 150 forces each of the sheet members, particularly primary member 112, into engagement with web 190 against roll 100. The retarder sheet 114 is bowed to conform to the roll, as a result of pressure applied to its tip region by the cantilevered end of conformer member 118. As seen most clearly in FIG. 1*e*, as the web emerges from under the edge 112' of the primary member 112, it expands vertically to fill the cavity between roll 100 and retarder sheet 114, and compresses longitudinally. The web is retarded at the leading edge of each ridge 202.

Figure 2:
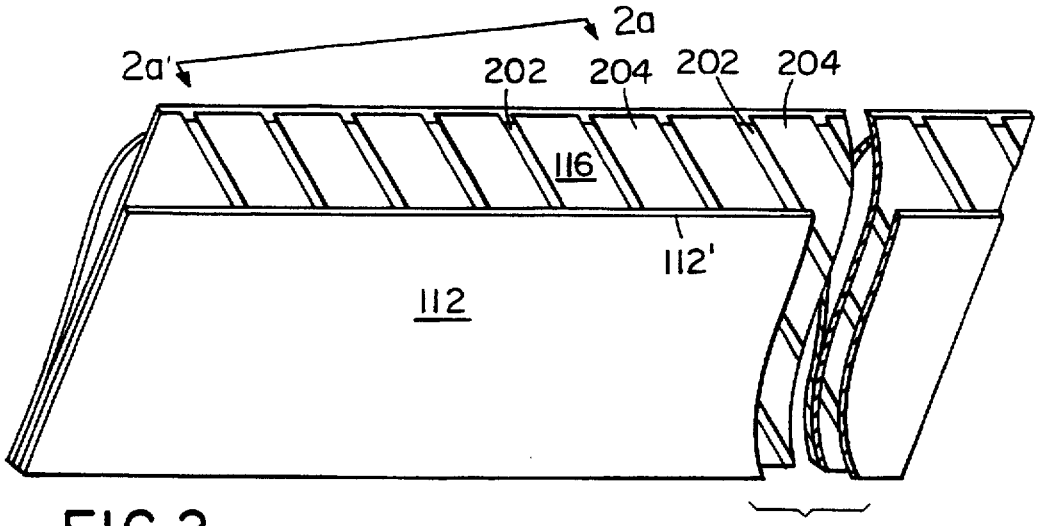
Figure 2A:
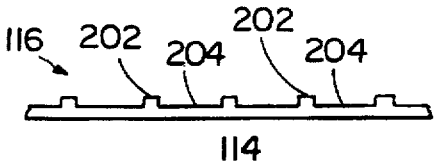

Referring to FIGS. 2 and 2*a*, the roll-facing surface of a retarder sheet has a retarder surface comprising a large multiplicity of parallel ridges 202 and grooves 204 biased obliquely to the direction of drive of the web. As shown in FIG. 2*a*, in one such retarder sheet, the overall thickness of the polished steel sheet is 0.010", the ridges are 0.010" wide and the grooves are 0.040" wide and 0.005" deep. Bias angles of 10° to 50° from the direction of drive have been found useful, and 30° to 45° preferable, varying with the material to be treated. Because this retarder surface does not have sharp points (as would be found on a roughened retarder surface), the biased retarder surface does not pick loops from the web, nor cause fuzziness in the web, nor raise dust.

In the invention, the retarder sheet of FIGS. 2 and 2*a* is modified so that the web, after initially being diverted by the grooves and ridges to travel at an angle to the original direction of drive induced by the drive roll, is reoriented to travel in a direction generally parallel to the original direction of drive 106, thereby causing the web to ratchet past the grooves and ridges 202. This reorienting overcomes a deficiency of the unmodified retarder sheet, in that the web emerges from the microcreper in a square conformation, rather than deformed into a parallelogram.

Figure 3:
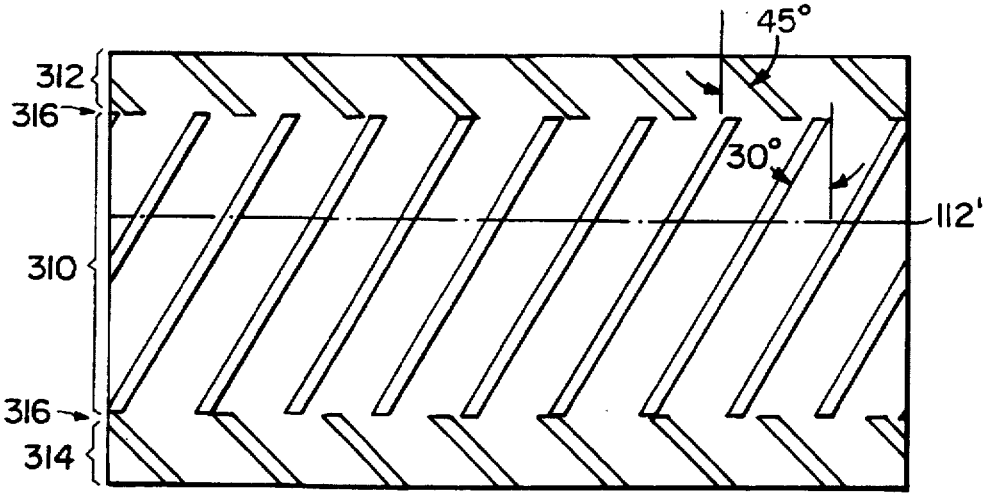
Figure 3A:
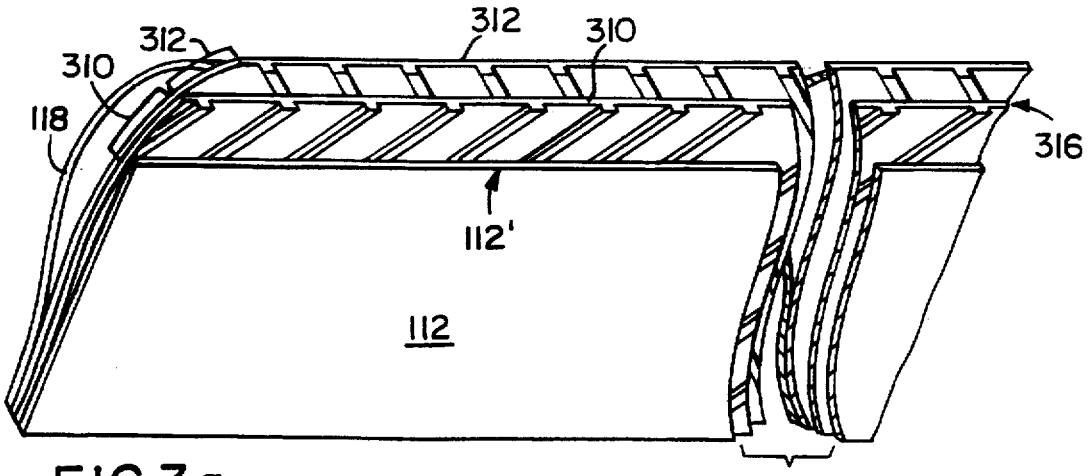
Figure 3B:
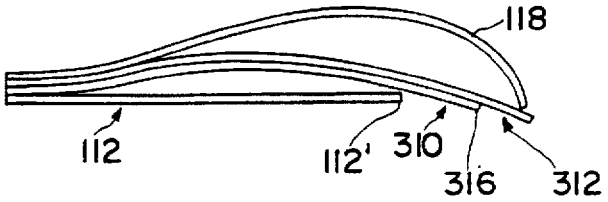

FIGS. 3, 3*a* and 3*b* show an embodiment of the invention in which the retarder sheet of the invention is divided into three regions. The center region 310 uses 0.010" ridges and 0.040×0.005" grooves biased at 30°, as in the retarder sheet of FIG. 2. In addition, a strip 312 of 0.010" ridges and 0.040×0.005" grooves back-biased at −45° is appended on the downstream edge. Typically, half or more of the retarder sheet is covered under the primary sheet member, the edge 112' of which is shown in phantom. As the retarder sheet wears, it can be reversed end-for-end, exposing the other −45° region 314, doubling the life of the retarder sheet. The full length of the center 30° portion 310 (measured in the direction of drive of the web) is typically two inches, about ¾" of which is typically exposed out from under the primary member. The length of −45° sections 312 and 314 is typically ¼". Because the grooves of both the 30° and −45° regions are set on the same 0.050" centers, the grooves do not meet end-for-end at the boundary 316 between the regions. As most clearly seen in FIG. 3*b*, the sheet is precurved to conform to the circumference of the roll, and conformer member 118 exerts its maximum force very near the downstream edge of the retarder. Thus, the downstream edge of the retarder surface exerts a larger force on the web than more-upstream portions of the retarder.

The 30 °/−45° embodiment can either be milled into a single sheet as shown in FIG. 3, or the embodiment can be formed of a 45° sheet lapped over a 30° sheet, as shown in FIGS. 3*a* and 3*b*.

The embodiment of FIGS. 3, 3*a* and 3*b* is especially useful for knits thicker than 0.030", for instance fleecy knits with a nap. The web is fed through the microcreper with the nap face against the roll.

Figure 4:
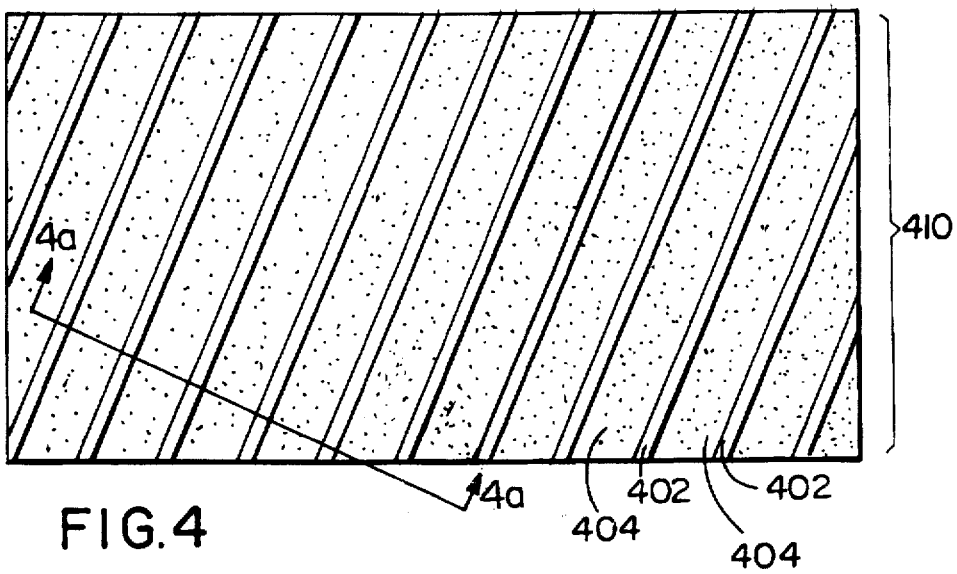
Figure 4A:
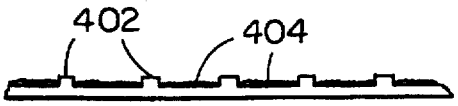

Referring to FIG. 4, in a second embodiment, a 30° single-region 410 retarder sheet is plasma-coated with tungsten carbide to a roll surface 100–120 RMS. The plasma coating is sanded or stoned off of the ridges. Thus, as shown in section in FIG. 4*a*, the retarder sheet has slightly-roughened grooves 404 and smooth ridges 402. The roll is also typically plasma-coated, to a surface roughness of RMS 100–110. Thus, the retarder grooves are somewhat smoother than the roll surface. The embodiment of FIG. 4 is especially useful for treating knits of 0.025" thickness or less, for instance piqué, jersey and interlock knits which are typically about 0.015" thick.

Figure 5:
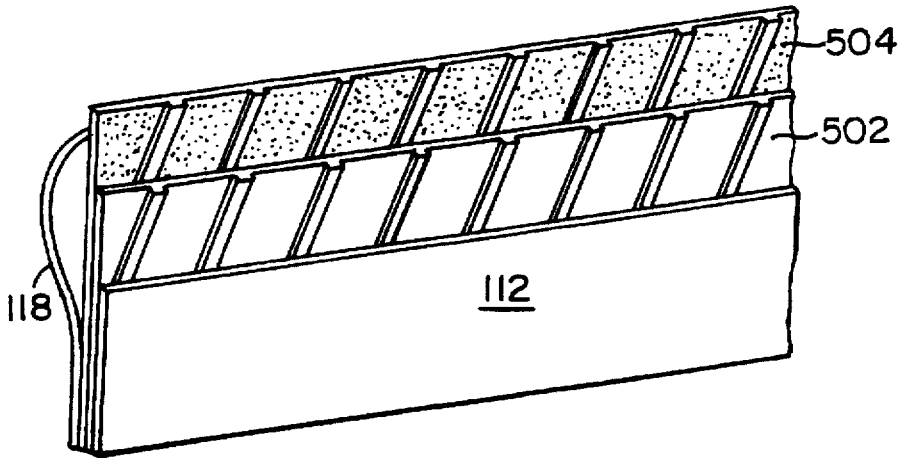
FIG. 5 is a side plan view of a sheet assembly.

Referring to FIG. 5, in a third embodiment, the retarder surface includes an uncoated 30° ridge-and-groove retarder sheet 502 followed by a plasma-coated 30° ridge-and-groove retarder sheet 504. This retarder surface works well to reduce shine or gloss on the surface of the web.

It is desireable that the edges of the ridges, especially the upstream edge of each ridge, be relatively sharp. As the retarder sheet wears, the edges should be periodically resharpened, for instance by replacing the retarder sheet, by reversing the member and exposing a new surface, by stoning the faces smooth, or by running the microcreper with no web engaged, thereby polishing the retarder sheet against the face of the roll.

The retarder sheet, especially the faces of the ridges, can be chrome-plated for longer life.

Note that the mirror image of each of the three retarder sheets would work just as well. Bias angles for regions 310, 410, 502, and 504 from 20° to 40° may be useful, and for edge strip 312 from –40° to –50°. The configuration of the ridges and grooves may vary with the nature of the web. The grooves should be wider than the ridges, preferably several times wider. The ridges should be on centers no wider than 0.25" and no narrower than 0.010", and will typically be near the inter-rib spacing of the knit. The retarder sheet should be fairly thin, typically 0.010", so that it is flexible enough to conform to the roll. This, in turn, limits the depth of the grooves to no more than the thickness of the retarder sheet.

All knit fabrics have ribs or similar surface features produced by the loops of the knit. In some knits, the ribs are subtle, for instance the lines where threads of adjacent loops cross. Some knits have obvious ribs; these should not be crushed by the microcreper. It has been found preferable that the ridge-to-ridge spacing of the retarding surface be about equal to the rib-to-rib spacing of the fabric, up to a few times larger. It is believed that the ridges should have flat top faces, rather than, for instance, a saw-tooth profile.

The choice from among the three embodiments, or from among other embodiments within the claims, will vary with the material to be treated, and the desired result of the treatment.

Chemical milling is the preferred method of forming the grooves into the retarder sheet, though various ablating, grinding and machining methods are also possible.

In a knit manufacturing line, a microcreper is typically the last step in the line before the knit web is inspected and batched (rolled or folded) for shipment to a finished goods manufacturer. Knitting machines typically knit a tube of material; before batching the material undergoes a number operations, including slitting, that impart desireable and undesirable deformations to the web. Among the undesirable deformations are those that stretch the web longitudinally, causing it to neck down laterally, and those that stretch the web non-uniformly. Further, the weight of the yarn varies, imparting further non-uniformity to the web.

A microcreper with a grooved retarder sheet according to the invention generally causes the web to compact longitudinally and regain some of its lateral width, and allows much of the non-uniform deformation to even out across the length and width of the web, without deforming the web into a parallelogram. Further, the described retarder surfaces allow this evening-out to occur in spite of the unevenness of the yarn, etc. For instance, a grooveless plasma-coated retarder sheet has been found to produce streaks in the web where irregularities in the web are retarded differentially and unevenly stretch the web.

The retarder sheets of the invention, with biased grooves and a grooved reorienting retarding surface, result in webs with especially desireable properties, apparently because the diagonal ridges and grooves function as small compaction zones: each ridge tends to isolate irregularities in one groove's compaction zone from the next groove's zone. Also, the web receives multiple compressive treatments as it is driven under multiple grooves and ridges before it leaves the retarder surface.

Referring again to FIG. 1*e*, in these three embodiments, the web follows the drive roll 100 and is gradually pressed between the roll and the smooth under-surface of the primary member 112, into driving engagement with the gripping surface of the roll. When the web emerges from under the edge 112' of the primary, it immediately engages the ridges 202 of the retarding surface or against previously compressed material, and longitudinally compacts. In the case of embodiments employing roughening of the surface within the grooves of the retarder, e.g. FIGS. 1*b* and 2, the roughening resists sliding of the web along the biased ridges 202, causing enhanced compaction. Thus, the web thickens and engages the drive roll sufficiently that the urging of the drive roll takes over and causes the web to resume travel essentially parallel to the original direction of drive, so that the web passes over the ridges of the downstream portion of the retarder.

In the 30°/–45° embodiment of FIGS. 3, 3*a* and 3*b*, the web initially slides along the 30° ridges, during which it may be progressively compressed longitudinally. When the web reaches the –45° section, because of the curvature of the retarder member and the force exerted by conformer member 118, significant retarding can be applied at this downstream edge of the retarder. Also, the now-thickened web is forced to leave the original grooves and pass over the ridges of the reverse set. Therefore, in this region, the web is caused to more tightly engage the drive roll surface, and the forward urging of the drive roll causes the web to reorient to essentially follow the direction of the drive roll.

Figure 6:
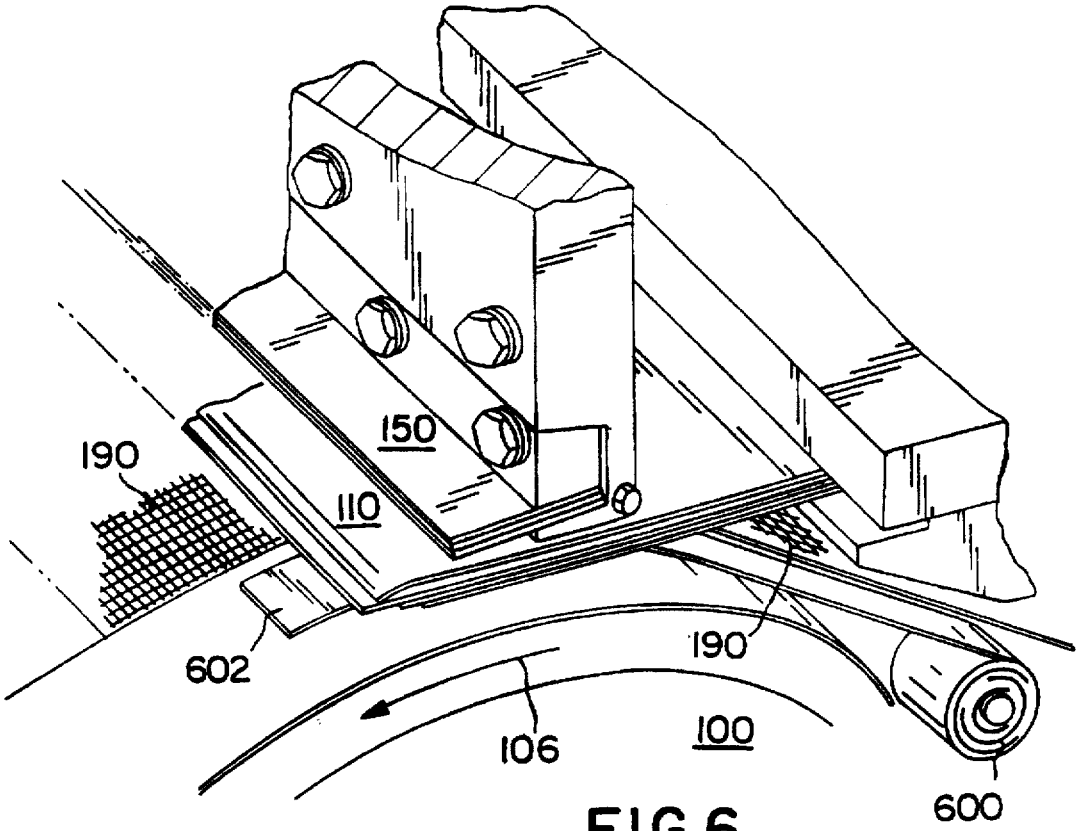
FIG. 6 is a perspective view of a microcreper, partially cut-away.

Referring to FIG. 6, the web under treatment is often narrower than the full width of the drive roll and sheet assembly. The sheet assembly 110 drags on the drive roll 100, and both wear prematurely. A roll 600 of a tough, slippery plastic tape 602, for instance 8"×5 mil mylar, can be mounted between the sheet assembly 110 and the drive roll 100. The tape roll is mounted on a fixed shaft so that it does not unroll under the force applied by the drive roll, but can be inspected every hour or so and advanced as necessary by an operator. Thus, the drive roll slips against the relatively slippery and inexpensive tape 602 instead of wearing against the relatively hard and expensive sheet assembly 110. The tape can be positioned on the shaft, by sliding in the direction of the axis of the roll, so that the space between the edge of the tape and the edge of the web is narrow enough so that the sheet assembly is cantilevered at both ends of the space and does not drag on the roll.

Other embodiments are within the following claims.

What is claimed is:

1. An apparatus for longitudinal compressive treatment of a continuous web of material, the apparatus comprising:

a cylindrical drive roll for advancing the web a smooth-surfaced primary member arranged over the drive roll to press the web into driven engagement with the drive roll, and a generally-stationary retarder downstream of said primary member positioned to engage and retard the web before the web has left said drive roll, said retarder defining:

a first initially-effective retarder surface facing the web comprising a large multiplicity of parallel ridges and grooves in a set that corresponds to the width of the web to be treated, the ridges and grooves being uniformly biased at a first acute angle relative to the direction of drive of the web, and a second retarder surface disposed to engage the web after advance of the web along said first retarder surface, said second retarder surface comprising a large multiplicity of parallel ridges and grooves in a set that corresponds to the width of the web to be treated, these ridges and grooves being uniformly biased at a second acute angle relative to the direction of drive of the web in an opposite sense to the sense of said first acute angle, said second acute angle being greater than said first acute angle such that the web passes over the ridges of said second retarder surface, said first and second retarder surfaces cooperating to orient the web to flow at a final flow angle to the original direction of drive of the web induced by said drive roll, the final flow angle being less than said first angle.

2. The apparatus of claim 1 wherein said first acute angle is about thirty degrees and said second acute angle is about forty-five degrees.

3. The apparatus of claim 1 wherein said grooves have rough surfaces, and said ridges have smooth flat top surfaces over which the web can slide.

4. The apparatus of claim 3 wherein said roughening is applied to the surface within said grooves by plasma coating.

5. The apparatus of claim 3 wherein said drive roll has a rougher surface than the surface within said grooves.

6. The apparatus of claim 1 wherein said retarder comprises a sheet-form member mountable in first and second configurations within said apparatus, said retarder comprising first and second portions, wherein in said first configuration, said first portion is exposed to wear and said second portion is not exposed to wear, and in said second configuration, said second portion is exposed to wear and said first portion is not exposed to wear.

7. The apparatus of claim 1 wherein said ridges have flat top surfaces over which the web can slide.

8. The apparatus of claim 7 wherein said ridges have sharp edges.

9. The apparatus of claim 7 wherein said flat-surfaced ridges are plated with a hard, smooth material.

10. The apparatus of claim 1 wherein the primary member and retarder comprise an assembly of superposed sheet members that correspond to the width of the web on said drive roll.

11. The apparatus of claim 1 for use with a predetermined web of knit fabric with ribs, and the ridge-to-ridge spacing of said first initially-effective retarder surface is between one and five times the rib-to-rib spacing of the knit.

12. The apparatus of claim 1 for use with a predetermined web of knit fabric, the ridge-to-ridge spacing of said first initially-effective retarder surface being between one and five times the loop length of the knit.

13. A method of longitudinal compressive treatment of a sheet material, the method comprising:

providing a continuous web of said material;

providing an apparatus comprising:

a cylindrical drive roll for advancing the web, a smooth-surfaced primary member arranged over the drive roll to press the web into driven engagement with the drive roll, and a generally-stationary retarder downstream of said primary member positioned to engage and retard the web before the web has left said drive roll, said retarder defining:

a first initially-effective retarder surface facing the web comprising a large multiplicity of parallel ridges and grooves in a set that corresponds to the width of the web to be treated, the ridges and grooves being uniformly biased at a first acute angle relative to the direction of drive of the web, and a second retarder surface disposed to engage the web after advance of the web along said first retarder surface, said second retarder surface comprising a large multiplicity of parallel ridges and grooves in a set that corresponds to the width of the web to be treated, these ridges and grooves being uniformly biased at a second acute angle relative to the direction of drive of the web in an opposite sense to the sense of said first acute angle, said second acute angle being greater than said first acute angle such that the web passes over the ridges of said second retarder surface, said first and second retarder surfaces cooperating to orient the web to flow at a final flow angle to the original direction of drive of the web induced by said drive roll, the final flow angle being less than said first angle; and passing the web through said apparatus to treat said web.

14. The method of claim 13 wherein said material comprises a fleece knit, and said first acute angle is about thirty degrees and said second acute angle is about forty-five degrees, the ridges of said first retarder surface and the ridges of said second retarder surface having smooth top surfaces over which the web can slide.

15. The method of claim 13 wherein said material comprises a piqué, jersey, or interlock knit of thickness less than 0.025", the grooves of said first retarder surface and the grooves of said second retarder surface having rough surfaces, and the ridges of said first retarder surface and the ridges of said second retarder surface having smooth top surfaces over which the web can slide.

16. A method for manufacture of knit fabric, comprising the steps:

knitting yarn into a knit tube;

processing said knit tube in a processing line that includes apparatus to slit said knit tube into a flat configuration, wherein as a by-product of said processing, said web is deformed to have variations in density across its length and width;

processing said deformed web in a microcreping apparatus comprising:

a cylindrical drive roll for advancing the web, a smooth-surfaced primary member arranged over the drive roll to press the web into driven engagement with the drive roll, and a generally-stationary retarder downstream of said primary member positioned to engage and retard the web before the web has left said drive roll, said retarder defining:

a first initially-effective retarder surface facing the web comprising a large multiplicity of parallel ridges and grooves in a set that corresponds to the width of the web to be treated, the ridges and grooves being uniformly biased at a first acute angle relative to the direction of drive of the web, and a second retarder surface disposed to engage the web after advance of the web along said first retarder surface, said second retarder surface comprising a large multiplicity of parallel ridges and grooves in a set that corresponds to the width of the web to be treated, these ridges and grooves being uniformly biased at a second acute angle relative to the direction of drive of the web in an opposite sense to the sense of said first acute angle, said second acute angle being greater than said first acute angle such that the web passes over the ridges of said second retarder surface, said first and second retarder surfaces cooperating to orient the web to flow at a final flow angle to the original direction of drive of the web induced by said drive roll, the final flow angle being less than said first angle;

said processing effective to reduce the variation of density of said web across its length and width.

17. An apparatus for longitudinal compressive treatment of a continuous web of material, the apparatus comprising:

a cylindrical drive roll for advancing the web, an assembly of one or more sheet-form members arranged over the drive roll in an engagement region to press the web into driven engagement with the drive roll, said drive roll and sheet assembly being wider than the web such that a portion of the engagement region between said sheet assembly and said drive roll is not occupied by the web, and a tape of a tough, slippery material, said tape held generally stationary in the portion of the engagement region between said sheet assembly and said drive roll not occupied by the web, said tape being constructed and arranged to reduce wear of the drive roll and sheet assembly without the tape affecting the driven engagement of the web.

18. The apparatus of claim 17 wherein said tape is composed essentially of polyester film.

19. An apparatus for longitudinal compressive treatment of a continuous web of material, the apparatus comprising:

a cylindrical drive roll for advancing the web, a smooth-surfaced primary member arranged over the drive roll to press the web into driven engagement with the drive roll, and a generally-stationary retarder downstream of said primary member positioned to engage and retard the web before the web has left said drive roll, said retarder defining an initially-effective retarder surface facing the web, comprising a large multiplicity of parallel ridges and grooves in a set extending across the width of the web to be treated, the ridges and grooves being uniformly biased at an angle to the direction of drive of the web, said ridges and grooves being effective to longitudinally compress the web and to orient the web to flow at a flow angle to the original direction of drive of the web induced by said drive roll, and a reorienting retarding surface disposed to be effective after an incremental advance of the web at said flow angle, said reorienting retarding surface constructed to have a supplementary retarding effect that is cooperative with said drive roll to reorient the travel of the web to a direction generally parallel to said original direction of drive, wherein said grooves have rough surfaces, and said ridges have smooth top surfaces over which the web can slide.

20. The apparatus of claim 19 wherein said roughening is applied to the surface within said grooves by plasma coating.

21. The apparatus of claim 19 wherein said drive roll has a rougher surface than the surface within said grooves.

22. An apparatus for longitudinal compressive treatment of a continuous web of material, the apparatus comprising:

a cylindrical drive roll for advancing the web, a smooth-surfaced primary member arranged over the drive roll to press the web into driven engagement with the drive roll, and a generally-stationary retarder downstream of said primary member positioned to engage and retard the web before the web has left said drive roll, said retarder defining an initially-effective retarder surface facing the web, comprising a large multiplicity of parallel ridges and grooves in a set extending across the width of the web to be treated, the ridges and grooves being uniformly biased at an angle to the direction of drive of the web, said ridges and grooves being effective to longitudinally compress the web and to orient the web to flow at a flow angle to the original direction of drive of the web induced by said drive roll, and a reorienting retarding surface disposed to be effective after an incremental advance of the web at said flow angle, said reorienting retarding surface constructed to have a supplementary retarding effect that is cooperative with said drive roll to reorient the travel of the web to a direction generally parallel to said original direction of drive, wherein said retarder comprises a sheet-form member mountable in first and second configurations within said apparatus, said retarder comprising first and second portions, wherein in said first configuration, said first portion is exposed to wear and said second portion is not exposed to wear, and in said second configuration, said second portion is exposed to wear and said first portion is not exposed to wear.

23. An apparatus for longitudinal compressive treatment of a continuous web of material, the apparatus comprising:

a cylindrical drive roll for advancing the web, a smooth-surfaced primary member arranged over the drive roll to press the web into driven engagement with the drive roll, and a generally-stationary retarder downstream of said primary member positioned to engage and retard the web before the web has left said drive roll, said retarder defining:

a retarder surface facing the web comprising a large multiplicity of parallel ridges and grooves in a set that corresponds to the width of the web to be treated, the ridges and grooves being uniformly biased at an acute angle to the direction of drive of the web, said grooves having rough surfaces, said ridges and grooves being effective to longitudinally compress the web.

* * * * *